United States Patent [19]

Spink et al.

[11] Patent Number: 4,616,554

[45] Date of Patent: Oct. 14, 1986

[54] EXTENDABLE TUBE FOR VERTICALLY DELIVERED WEAPONS

[75] Inventors: Thomas E. Spink, Ellicott City; Frank C. Rushing, Columbia, both of Md.

[73] Assignee: Westinghouse Electric Corp., Pittsburgh, Pa.

[21] Appl. No.: 640,424

[22] Filed: Aug. 13, 1984

[51] Int. Cl.[4] ..... F41F 3/042; F41F 3/052; F41F 3/06

[52] U.S. Cl. ..... 89/1.806; 89/1.815; 89/1.816

[58] Field of Search ..... 89/1.816, 1.817, 1.51, 89/1.818, 1.806, 1.8, 1.81 Z; 403/324, 321

[56] References Cited

U.S. PATENT DOCUMENTS

| | | | |
|---|---|---|---|
| 3,160,078 | 12/1964 | Hiemstra et al. | 92/18 |
| 3,534,653 | 10/1970 | Specht et al. | 89/1.815 |
| 3,608,426 | 9/1971 | Jackson, Jr. | 89/37.56 |
| 3,825,980 | 7/1974 | Moore | 24/634 |
| 3,960,054 | 6/1976 | Looger | 89/1.816 |
| 4,080,868 | 3/1978 | Matthews | 89/1.806 |
| 4,132,147 | 1/1979 | Contaldo | 89/1.58 |
| 4,191,087 | 3/1980 | Campbell et al. | 89/1.816 X |
| 4,336,740 | 6/1982 | Leigh et al. | 89/1.806 |
| 4,376,405 | 3/1983 | Madderra | 89/1.806 |
| 4,531,445 | 7/1985 | Nee | 89/1.816 X |

*Primary Examiner*—David H. Brown
*Attorney, Agent, or Firm*—W. G. Sutcliff

[57] ABSTRACT

An extendable rocket launcher tube for a rocket wherein releasable telescoped concentric inner and outer tubes house the rocket. Upon ignition, the rocket releases the inner tube from the outer tube and carries it forward imparting momentum thereto. The rocket is released from the inner tube at a selected axial extension of the inner tube. The components move at relative speeds such that acceleration of the rocket is complete when the launcher tube is fully extended.

13 Claims, 6 Drawing Figures

FIG. 1
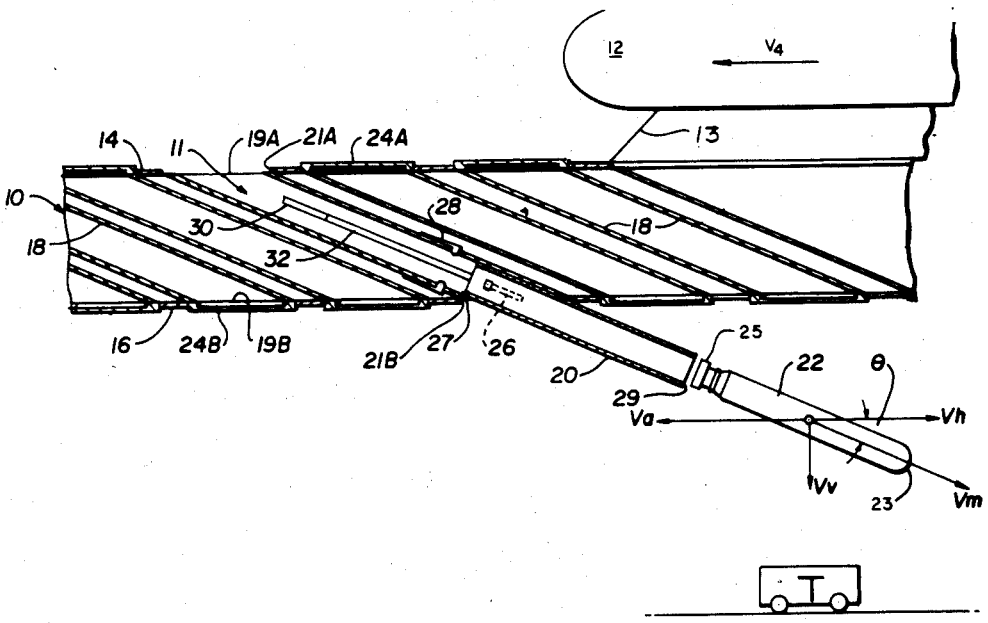
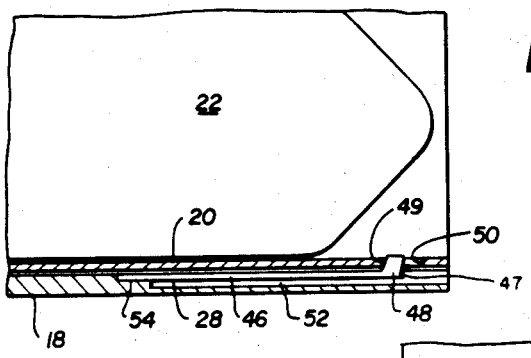
FIG. 3A
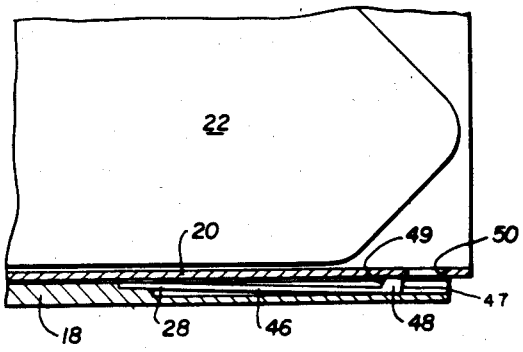
FIG. 3B

EXTENDABLE TUBE FOR VERTICALLY DELIVERED WEAPONS

BACKGROUND OF THE INVENTION

The present invention relates to a vertically delivered weapon system. In particular, the invention relates to a tube for launching a rocket. The tube is extendable to a length sufficient to contain and guide the rocket while it is burning and accelerating. In its retracted position, the tube is located within a pod or multiple rocket launch housing which contains a plurality of such rockets. The pod may contain the sensors, targeting hardware and launch hardware.

In a down fired weapon delivery system, a manned or unmanned low flying aircraft ejects a rocket over a target in a manner such that it travels straight down. Simple vector analysis shows that if a vehicle carrying the rocket is moving in the forward direction and the rocket is launched rearwardly at an angle, depending upon the speed of the launched vehicle, the forward and reverse components of the rocket and vehicle cancel, yielding a downward resultant vector only. Thus, an aircraft can fly at relatively low altitudes and fire directly over the target. At high speeds, the launch can occur in a few milliseconds.

Rockets of the type herein described are launched from tubes which have a length sufficient to contain and guide the rocket while it is burning and accelerating. For example, some relatively small single and multiple warhead rockets require a launch tube as long as 36 inches in order to allow the rocket to achieve maximum acceleration and guidance. If the launch tube is pointed downward at a 155° angle relative to the direction of the carrier vehicle, the tube presents a 20 inch drag surface. A pod carrying a multiplicity of such tubes represents a relatively large cross-section and contributes a large amount of drag to the vehicle at high speeds.

In order to retain the accuracy achieved by a relatively long launch tube sufficient to contain the rocket during its full burn, yet reduce the cross-section of the pod, and thereby reduce the drag, extendable telescopic tubes have been used. See for example, the patent to Madderra, Pat. No. 4,376,405, showing an extendable launch tube and locking mechanism for a launch vehicle. In Medderra, the extendable launch tube is extended by an undisclosed mechanism and locked in place. In the present invention, the launch tube is a telescopic device in which a portion of the tube is extended by the rocket and is eventually expended once the rocket is launched.

SUMMARY OF INVENTION

There has been provided a launch tube for a rocket, including an outer tube and an inner tube telescopically located therein. The inner tube receives the rocket. Rocket latches, carried by the inner tube, secure the rocket axially relative to the inner tube. When compressed, the rocket latches project through side wall openings in the inner tube and engage the rocket. The outer tube receives the inner tube and rocket herein. Inner tube latches carried by the outer tube secure the inner tube therein. The inner tube latches project into openings in the inner tube. The inner wall of the outer tube engages the rocket latches and compresses the same for locking the rocket relative to the inner tube. Upon ignition, the inner tube latches release and the locked together rocket and inner tube move axially in the outer tube. Release surfaces, or recesses in the inner wall of the outer tube, accommodate expansion of the rocket latches to thereby release the rocket from the inner tube after the same has achieved its desired velocity. The rocket continues to accelerate and moves forward within the inner tube. The inner tube continues to move forward as a result of the momentum imparted to it upon ignition of the rocket. The acceleration of the rocket and the speed of the inner tube is such that the rocket exits the inner tube when the inner and outer tubes are fully extended. Thus, the full length of the inner and outer tubes are utilized for the launch.

DESCRIPTION OF THE DRAWINGS

FIG. 1 shows a side sectional view of a delivery pod with the extendable launch tube extended, and the rocket or munition leaving the exit end thereof.

FIGS. 3A and 3B show a latch mechanism for securing the inner tube and rocket within the outer tube before and after rocket ignition.

DESCRIPTION OF THE PREFERRED EMBODIMENT

Figure 2A:
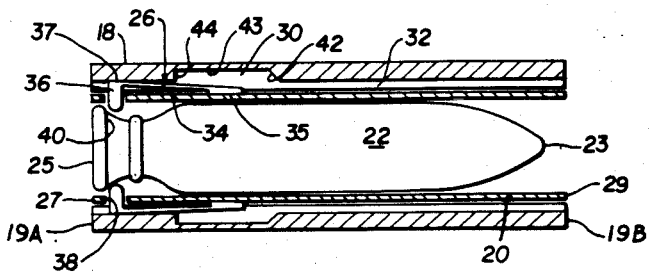
FIGS. 2A, 2B and 2C show a side sectional schematic of the extendable launch tube of the present invention in three operative stages of deployment.

FIG. 1 illustrates a down-fire vertical weapon delivery system including a multiple rocket pod 10 preferably adapted to be mounted to the underside of the wing of an aircraft 12 by means of an appropriate support 13. The pod 10 may also form the body of an unmanned remotely controlled missile. The pod 10 carries extendable launch tubes 11 of the present invention. For simplicity, only one complete extendable launch tube assembly 11 is shown.

The extendable launch tube 11 of the present invention includes an outer launch tube 18 and an inner launch tube 20 telescopically located therein. The respective inner and outer tubes are preferably cylindrical. The outer launch tubes have respective offset exhaust and exit ports 19A and 19B. Each is secured at an angle $\theta$ between the upper and lower walls 14 and 16 of the pod 10 in corresponding offset openings 21A and 21B as shown. Each inner launch tube 20 has a rocket 22 sleeved therein in a telescopically collasped configuration. Each rocket 22 and corresponding inner launch tube 20 is secured by a releasable rocket latch 26. The inner launch tube 20 and corresponding rocket 22 are secured as a unit within the outer launch tube 18, in a telescopically collasped initial configuration, by means of a releasable inner tube latch 28. Each rocket 22 and inner launch tube 20 is installed within a corresponding outer launch tube 18 through the exhaust opening 19A in the pod 10. Covers 24A and 24B may be located over each of the corresponding openings 19A and 19B for each of the corresponding extendable launch tubes 11.

Upon ignition of the rocket 22, the exit cover 24A is blown away. The rocket ignition exerts axial force on the inner launch tube 20 sufficient to release the inner tube latch 28. Upon release of the inner tube latch 28, the inner launch tube 20 and rocket 22 move together as a unit axially of the outer tube 18 through the exit opening 19B, blowing away the exit cover 24B. When the rocket 22 and the inner tube 20 reach a selected axial position, the rocket latch 26 is released such that the rocket 22 moves within the inner launch tube 20, which itself continues to move with respect to the outer launch tube 18.

In FIG. 1 the components are shown fully extended, end to end. The inner launch tube 20 has its rearward end 27 located just at the exit opening 19B. The rocket 22 is shown with its tail portion 25 at the forward end 29 of the inner launch tube 20. Thus, the rocket 22 has had the benefit of the required launch tube length for acceleration and guidance without presenting an inordinate surface area or wind drag for the entire flight of the aircraft 12.

In the drawing, the rocket 22 is shown having a muzzle velocity Vm with respect to the aircraft. The aircraft 12 is assumed to be flying straight and level at a velocity Va. The horizontal component Vh of the rocket is calculated as Vm sin $\theta$. Knowing the rocket velocity, Vm, and the angle of deployment, $\theta$, the aircraft speed may be adjusted so that Va equals Vh. Thus, the rocket 22 has only a vertical component Vv in the direction of the target T.

It should be understood that the inner launch tube 20 is expended each time a rockeet 22 is launched. That is, it simply leaves the outer launch tube 18 by its own momentum.

Figure 2B:
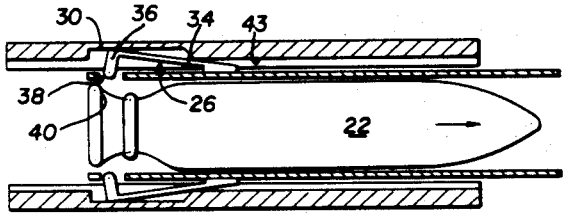
Figure 2C:
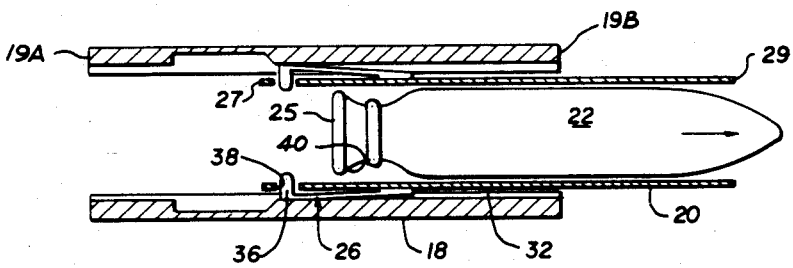

Referring now to FIGS. 2A, 2B and 2C, the mechanism by which the components attain full extension is illustrated. In FIG. 2A, the rocket 22 and the inner launch tube 20 are shown installed within the outer launch tube 18 in an initial position. The rocket 22 is held within the inner launch tube 20 by means of a rocket latch 26 comprising a leaf spring 34 secured to the outside of the inner tube 20 at a mount 35 and extending rearwardly thereof towards a free end having a radial pin 36 mounted thereon. The pin 36 is aligned with, and extends through, an aperture 38 in the inner tube 20. The rocket 22 has a latch surface 40. The pin 36 engages the latch surface 40 as shown, and thereby secures the rocket 22 with respect to the inner tube 20.

The leaf spring 34 is biased to draw the pin 36 radially outwardly from the aperture 38. In the position shown in FIG. 2A, a rear surface 37 of the leaf spring 34 engages the inside surface of the outer tube 18 and is compressed inwardly of the aperture 38 so that the pin 36 engages the latch surface 40 of the rocket 22, thereby securing the rocket therein.

The outer tube 18 has a rocket latch release 30 and a groove 32 located inwardly on the interior surface thereof. The rocket latch release 30 comprises a detent in the inner wall of the outer tube 18. The detent includes a front transition surface 42, a stepped rear surface 44 and an intermediate radially off-set release surface 43 joining the two.

As can be more clearly seen in FIG. 2B, upon ignition the rocket 22 tends to move forward in the direction shown. Because the rocket is secured within the inner launch tube 20 by means of the rocket latch 26, the inner launch tube 20 moves with the rocket to an extended position shown in FIG. 2B. In this position, the rocket latch 26 expands against the release surface 43 of the latch release 30. The leaf spring 34 withdraws the pin 36 from the aperture 38, thereby releasing the latch surface 40 of the rocket as shown. The rocket 22 continues to burn and accelerate in the inner launch tube 20. Further, the inner launch tube 20, having received momentum, continues to move forward within the outer launch tube 18.

The rear surface 37 of the leaf spring 34 moves out of engagement with the release surface 43 and into engagement with the front transition surface 42 and groove 32 of the outer launch tube 18. However, by this time the rocket 40 has moved past the pins 36 and is free to accelerate until its tail 25 reaches the front end 29 of the inner launch tube 20. Simultaneously, the inner launch tube 20 moves within the outer launch tube 18 such that its rear end 27 passes from the exit end 19B of said outer launch tube 18.

Depending upon the acceleration of the rocket 22, frictional forces, wind drag and the like, the system may be controlled such that the outer launch tube 18, the inner launch tube 20, and the rocket 22 are fully extended, end to end, at the time the rocket leaves the inner launch tube. Thus, the rocket has the benefit of the fully extended launch tube system and can achieve maximum acceleration and guidance.

The preferred order of installing a rocket 22 within the pod 10 may be generally as a unit described as follows: the rocket 22 may be first installed or telescoped within the inner launch tube 20 such that the latch surface 40 of the rocket is located rearwardly of the pin 38 as described above. The rocket 22 and inner tube 20 may be installed or telescoped within the outer launch tube 18 as a unit through the exhaust opening 19A. The leaf spring 34 is aligned with the grooves 32 in the inner wall of the outer launch tube 18, and the rocket 22 and inner launch tube 20 are telescoped into the outer launch tube 18. It should be understood that it may be possible to partially install the inner launch tube 20 before leaf springs 34 are compressed and install the rocket 22 separately. The two may thereafter be moved together into the position shown in FIG. 2A.

Referring to FIG. 3A, once the inner launch tube 20 is moved into the launch position shown in FIG. 2A, the inner tube latch 28 engages the inner tube 20 for locking the same in place. The inner tube latch 28 comprises a leaf spring 46 and pin 48 located at a forward end thereof. The rearward end of the leaf spring 46 is secured within the outer tube 18 at a mount 54. The leaf spring 46 is biased to be relaxed in a direction radially inwardly of the inner tube 20. An aperture 50 in the wall of the inner tube 20 receives a pin 48, thereby securing the inner tube 20 with respect to the outer tube 18. The outer tube 18 has a recess 52, which allows the leaf spring 46 and pin 48 to move radially outwardly with respect to the inner tube 20. The pin 48 has a tapered surface 47 which prevents outward movement of leaf spring 46 and pin 48 with reverse force on the inner tube 20. The pin 48 also has a smooth, tapered transition surface 49 which engages the aperture 50. Upon ignition, the force of the rocket urges the inner tube forward. The force causes the pin 48 to release into the position shown in FIG. 3B. Thus, once sufficient force is exerted on the inner tube 20, it moves. The transition surface 49 of the pin 48 and the aperture 50 move with respect to each other, thereby urging the pin 48 radially outwardly into the recess 52 to release the inner tube 20.

The latching force of the leaf spring 46 is sufficiently strong to avoid accidental release of the inner tube during take-offs, landings and the like.

The covers 24A and 24B for closing the respective exhaust and exit openings 19A and 19B may be any form of disposable material because the covers 24A and 24B are expended on launch.

What is claimed is:

1. An extendable rocket launcher adapted to secure a rocket therein and to provide guidance for said rocket during ignition and acceleration comprising:

inner and outer tubes wherein said rocket is concentrically secured within the inner tube and said rocket and said inner tube are concentrically secured within said outer tube in a telescoped configuration;

releasable rocket latch means being compressed for securing said rocket within said inner tube in fixed axial relation therewith;

rocket release means being axially positioned relative to said inner and said outer tubes for accommodating said releasable rocket latch means and allowing said releasable rocket latch means to become relaxed to thereby release said rocket from said inner tube;

releasably inner tube latch means adapted when relaxed to secure said inner and said outer tubes in axial relationship and to release said releasable inner tube latch means when said releasable inner tube latch means is so expanded outward away from said rocket upon application of sufficient force, whereby said inner and said outer tubes become axially extended relative to each other;

said inner tube being initially moveable with said rocket upon ignition thereof and said rocket traveling therewith a predetermined distance within said outer tube until said releasable rocket latch means encounters said rocket release means whereby said rocket moves relative to said inner tube and said rocket becomes extended with respect to said inner tube, said rocket, said inner tube and said outer tube moving with respect to each other such that said outer tubes are fully extended end to end at the same time that said rocket is fully extended with respect to said inner tube, and said rocket ignition is terminated and accleration with said extendable launch tube is completed whereby said rocket achieves maximum guidance over the entire extended length of said inner and said outer tubes.

2. In a rocket launching system adapted to be carried by a moving vehicle at relatively high speed in the atmosphere, operable to lauch a rocket, said rocket being subject to resulting wind drag, and wherein the ignition of said rocket causes said rocket to accelerate over a predetermined interval, an extendable launch tube for providing guide for said rocket and for containing said rocket over a substantial portion of the acceleration interval for reducing said wind drag, comprising:

an inner tube means for receiving said rocket concentrically in an initial telescopically collapsed configuration;

an outer tube means for receiving said inner tube means and said rocket concentrically and in initial telescopically collapsed configuration;

a releasable inner tube latch means coupled between said inner tube means and said outer tube means operable to secure said inner tube means and said outer tube means in said initial telescopically collapsed configuration and releasing said inner tube means from said outer tube means in response to sufficient axial force on said inner tube means resulting from said ignition and the acceleration of said rocket whereby said inner tube means and said outer tube means become axially extended with respect to each other;

a releasable rocket latch means coupled between said rocket and said inner tube means for securing said rocket and said inner tube means in their said respective initial telescopically collapsed configuration and releasing said rocket from said inner tube means in response to a predetermined axial extension of said inner tube means and said outer tube means, said rocket imparting a momentum to said inner tube means upon said ignition and until said rocket is released therefrom, and said rocket continuing its acceleration within said inner tube means and said outer tube means, said momentum imparted to said inner tube means by said rocket being sufficient to allow said inner tube means to become fully extended with respect to said outer tube means, and the relative speeds of said inner tube means and said outer tube means and said rocket being such that said inner tube means, said outer tube means and said rocket are all fully extended with respect to each other over said interval of accleration.

3. The apparatus of claim 2 wherein said outer launch tube has a recess near a forward end thereof, and the inner tube latch means includes a spring secured within the recess and a latch pin located at a free end of the leaf spring extending radially inwardly of the outer launch tube, the inner launch tube has at least one radial aperture located for engagement with the latch pin when in the initial telescopicaly collapsed configuration, said leaf spring and latch pin thereby locking the inner tube within the outer tube, said latch pin including a forwardly extending transition surface in engagement with a rearwardly radial surface of said aperture to allow the rear radial surface of the aperture to urge the pin radially outwardly in response to an axial force on the inner tube whereby the latch pin is driven radially into the recess for releasing the inner tube from said outer tube, and a forward tapered surface for engaging the aperture for preventing outward movement of the latch pin with reverse force on the inner tube.

4. The apparatus of claim 2 wherein the inner tube has at least one radial aperture, and the rocket has a latch surface axially located with respect to the aperture when the rocket and inner tube are in the initial telescopically collasped configuration, said rocket latch means includes a leaf spring secured to the outside of the inner tube and biased radially outwardly thereof, and a pin located at the free end of the leaf spring sleeved within the aperture and extending radially inwardly of said tube;

said rocket latch means adapted to engage an inner surface of the outer tube and becomes compressed thereby when the inner tube is in the initial telescopically collasped configuration for driving the pin into engagement with the latch surface of the rocket;

the inner surface of said outer tube having a radial recess corresponding to the selected axial extension of the inner and outer tubes, said recess for receiving the rocket latch means therein and allowing the same to expand into a relaxed condition to thereby allow the leaf spring to withdraw the pin from the aperture and out of engagement with the latch surface of the rocket for releasing the same when the inner tube moves from the initial collapsed configuration to the selected axial extended position.

5. The apparatus of claim 4 wherein said recess includes a transition surface for allowing a radially outward portion of the rocket latch means to smoothly slide thereagainst.

6. The apparatus of claim 5 wherein said outer launch tube has at least one axial groove for receiving the rocket latch means, said axial groove extending at least forwardly of the recess to a forward extent of said outer launch tube.

7. The apparatus of claim 5 wherein said inner and outer launch tubes are concentric cylinders.

8. The apparatus as set forth in claim 2 wherein a plurality of said outer launch tubes are arranged in parallel axial alignment at a selected angle relative to the horizontal, and upper and lower wall means joins said axially aligned outer launch tubes to form a pod for launching a plurality of said rockets.

9. The apparatus of claim 8 wherein the upper and lower walls have a plurality of respective off-set openings therein for receiving the plurality of said outer launch tubes therein.

10. The apparatus of claim 9 further including cover means for the openings in the outer launch tubes, said cover means being moved in response to ignition of the rocket and being expended upon launch.

11. An extendable launcher tube for a rocket comprising:

concentric inner and outer tubes having exit ends wherein the inner tube and rocket are telescopically and concentrically located in the outer tube;

releasable rocket latch means for securing the rocket within the inner tube in telescoped position;

releasable inner tube latch means for securing the inner and outer tubes in telescoped position;

the releasable inner tube latch means being biased to secure the inner and outer tubes in axial relationship and to release the inner tube from the outer tube upon the application of sufficient force in the direction of the exit end;

the releasable rocket latch means being biased to release the rocket from the inner tube at a selected axial position within the outer launch tube;

release means at the selected axial position within the outer tube for releasing the rocket latch means;

the inner tube being secured to the rocket and moveable with said rocket upon ignition thereof for applying the sufficient force to release the inner tube latch means, and said inner tube being free to move independently of the rocket when the rocket latch means encounters the release means within the outer tube;

the rocket, the inner tube and the outer launch tube move with respect to each other, such that, the extendable launcher tube is fully extended when the rocket leaves the exit end thereof.

12. An extendable launch tube for a rocket comprising:

an inner tube for receiving the rocket concentrically in telescoped configuration;

an outer tube for receiving the inner tube and rocket concentrically in telescoped configuration;

releasable inner tube latch means coupled between the inner and outer tubes for securing the tubes in the telescoped configuration and releasing the inner tube from the outer tube in response to sufficient axial force on said inner tube whereby the inner and outer tubes become axially extended;

releasable rocket latch means coupled between the rocket and inner tube for securing them in the telescoped configuration and releasing the rocket from the inner tube in response to a selected axial extension of the inner and outer tubes.

13. An extendable launcher tube for a rocket comprising:

inner and outer tubes wherein the rocket is located concentrically within the outer tube in a telescoped configuration;

releasable rocket latch means for securing the rocket within the inner tube in the telescoped configuration;

releasable inner tube latch means for securing the inner and outer tubes in the telescoped configuration;

the releasable inner tube latch means being biased to maintain the inner and outer tubes in the telescoped configuration and to release the inner tube from the outer tube upon the application of sufficient axial force whereby the inner and outer tubes move axially one with respect to the other;

the releasable rocket latch being biased to release the rocket from the inner tube when the inner and outer tubes are at a selected axial position;

the inner tube being initially secured to the rocket and moveable therewith in response to the application of force created by rocket ignition whereby the sufficient force is applied to release the inner tube latch means, and the rocket latch means being responsive to the position of the inner tube within the outer tube for releasing the rocket from the inner tube when the two are in the selected axial position;

the force releasing the inner tube from the outer tube being sufficient to impart momentum to the inner tube so that it becomes fully extended with respect to said outer tube and separate therefrom, and the rocket ignition accelerating the rocket within said inner and outer tubes so as to become fully extended with respect to the inner tube when said inner tube is fully extended with respect to the outer tube.

* * * * *